US010104917B2

(12) United States Patent
Liao et al.

(10) Patent No.: US 10,104,917 B2
(45) Date of Patent: Oct. 23, 2018

(54) SHAPE ENHANCING GARMENTS WITH DISCONTINUOUS ELASTIC POLYMER COMPOSITION

(71) Applicant: INVISTA TECHNOLOGIES S.A R.L., St. Gallen (CH)

(72) Inventors: Tianyi Liao, Chadds Ford, PA (US); Hong Liu, Waynesboro, VA (US); Douglas K. Farmer, Greensboro, NC (US)

(73) Assignee: INVISTA North America S.a r.l., Wilmington, DE (US)

( * ) Notice: Subject to any disclaimer, the term of this patent is extended or adjusted under 35 U.S.C. 154(b) by 130 days.

(21) Appl. No.: 15/097,564

(22) PCT Filed: Dec. 2, 2014

(86) PCT No.: PCT/US2014/068192

§ 371 (c)(1),
(2) Date: Apr. 13, 2016

(87) PCT Pub. No.: WO2015/084865

PCT Pub. Date: Jun. 11, 2015

(65) Prior Publication Data

US 2017/0172219 A1 Jun. 22, 2017

Related U.S. Application Data

(60) Provisional application No. 61/910,713, filed on Dec. 2, 2013.

(51) Int. Cl.
*A41C 1/00* (2006.01)
*A41D 31/00* (2006.01)
(Continued)

(52) U.S. Cl.
CPC ..... *A41C 1/003* (2013.01); *A41C 1/08* (2013.01); *A41D 1/06* (2013.01); *A41D 13/0017* (2013.01);
(Continued)

(58) Field of Classification Search
CPC ..... A41C 1/08; A41D 1/00; A41D 13/0017
(Continued)

(56) References Cited

U.S. PATENT DOCUMENTS 4,701,964 A * 10/1987 Prunesti ..... A41C 1/003 2/406
4,776,916 A * 10/1988 Prunesti ..... A41C 1/003 156/291
(Continued)

FOREIGN PATENT DOCUMENTS

EP 0519135 B1 11/1996
EP 1136001 A1 9/2001
(Continued)

OTHER PUBLICATIONS

Siggia, S., "Quantitative Organic Analysis via Functional Group", 3rd Edition, Wiley & Sons, New York, 1963, pp. 559-561.
(Continued)

*Primary Examiner* — Gloria Hale
(74) *Attorney, Agent, or Firm* — Bridget C. Sciamanna; Kathleen A. Tyrrell

(57) ABSTRACT

A garment with shape enhancing function. The garment includes an elastic fabric and polymer composition to enhance shaping.

19 Claims, 7 Drawing Sheets

(51) Int. Cl.

| | |
|---|---|
| ***D06M 15/564*** | (2006.01) |
| ***D06M 23/16*** | (2006.01) |
| ***A41C 1/08*** | (2006.01) |
| ***A41D 1/06*** | (2006.01) |
| ***A41D 13/00*** | (2006.01) |
| ***D06N 7/00*** | (2006.01) |
| ***D06M 15/227*** | (2006.01) |
| ***D06M 15/568*** | (2006.01) |
| ***D06M 15/693*** | (2006.01) |
| ***D06N 3/10*** | (2006.01) |
| ***D06N 3/14*** | (2006.01) |
| ***D06N 3/00*** | (2006.01) |
| *D06M 23/08* | (2006.01) |
| *D06M 101/32* | (2006.01) |
| *D06M 101/38* | (2006.01) |

(52) U.S. Cl.

CPC ..... *A41D 31/00* (2013.01); *D06M 15/227* (2013.01); *D06M 15/564* (2013.01); *D06M 15/568* (2013.01); *D06M 15/693* (2013.01); *D06M 23/16* (2013.01); *D06N 3/0027* (2013.01); *D06N 3/10* (2013.01); *D06N 3/145* (2013.01); *D06N 7/0092* (2013.01); *A41D 2400/38* (2013.01); *A41D 2500/54* (2013.01); *D06M 23/08* (2013.01); *D06M 2101/32* (2013.01); *D06M 2101/38* (2013.01)

(58) Field of Classification Search

USPC ..... 450/94–95, 97, 100, 101, 107, 109, 450/114–118, 122–124, 130–132

See application file for complete search history.

(56) References Cited

U.S. PATENT DOCUMENTS

| | | | | |
|---|---|---|---|---|
| 5,447,462 | A * | 9/1995 | Smith | A41C 1/003 2/73 |
| 5,916,829 | A * | 6/1999 | Girard | A41C 5/00 442/182 |
| 7,240,371 | B2 * | 7/2007 | Liu | B32B 7/12 2/1 |
| 7,341,500 | B2 | 3/2008 | Horn et al. | |
| 7,945,970 | B2 | 5/2011 | Belluye et al. | |
| 7,950,069 | B2 | 5/2011 | Lee | |
| 9,689,091 | B2 * | 6/2017 | Liao | D04B 1/18 |
| 9,854,861 | B2 * | 1/2018 | Covelli | A41D 27/02 |
| 2002/0106970 | A1 * | 8/2002 | Falla | A41B 17/00 450/1 |
| 2004/0111781 | A1 * | 6/2004 | Miyake | A41C 1/003 2/69 |
| 2004/0182499 | A1 * | 9/2004 | Collier, IV | A61F 13/4902 156/164 |
| 2008/0014387 | A1 * | 1/2008 | Murphy | A61F 13/00991 428/34.1 |
| 2009/0088037 | A1 * | 4/2009 | Covelli | B32B 27/32 442/76 |
| 2009/0181599 | A1 | 7/2009 | Farmer et al. | |
| 2010/0064409 | A1 | 3/2010 | Buckley | |
| 2011/0041232 | A1 * | 2/2011 | Covelli | A41D 27/02 2/69 |
| 2011/0214216 | A1 | 9/2011 | Zarabi | |
| 2012/0100351 | A1 * | 4/2012 | Covelli | B32B 5/04 428/196 |
| 2013/0302574 | A1 | 11/2013 | Liu et al. | |
| 2017/0172219 | A1 * | 6/2017 | Liao | A41C 1/003 |

FOREIGN PATENT DOCUMENTS

| | | | |
|---|---|---|---|
| EP | 2484822 | A1 | 8/2012 |
| EP | 2280619 | B1 | 7/2013 |
| GB | 2477754 | A | 8/2011 |
| WO | 2009/135155 | A2 | 11/2009 |
| WO | 2013/154445 | A1 | 10/2013 |
| WO | 2015/084865 | A1 | 6/2015 |

OTHER PUBLICATIONS

International Preliminary Report on Patentability Report Received for PCT Patent Application No. PCT/US2014/068192, dated Jun. 16, 2016, 7 pages.

International Search Report and Written Opinion Received for PCT Application No. PCT/US2014/068192, dated Apr. 7, 2015, 9 pages.

* cited by examiner

SHAPE ENHANCING GARMENTS WITH DISCONTINUOUS ELASTIC POLYMER COMPOSITION

FIELD OF INVENTION

The present invention relates a shape enhancing garment including a base elastic fabric region and at least one fabric composite zone, wherein, an elastic polymer composition, such as a polyurethaneurea, a polyurethane, or a polyolefin, is discontinuously placed in the fabric back, penetrates and anchors into the fabric inside, and is not visible from the outside of the fabric. The garments have the shaping and slimming features in the predetermined locations without sacrificing the comfort and appearance. Methods of making the garments are also included.

SUMMARY OF RELATED TECHNOLOGY

A shaping garment is designed to temporarily alter the wearer's body shape to achieve a more fashionable figure. In recent years, fashion trends have tended to embrace clothing and apparel designs that increasingly accentuate natural curves of the human body, and the shape wear has been a growing trend in the market. The primary application has been in women's apparel, such as inner wear, lingerie, jeans and woven pants. Many women consumers look for comfortable garment that enhance her shape while highlighting her best features, for example, a shaping jean that can slim the tummy, tighten the thigh and lift the buttock. Such a garment improves the appearance and self-esteem of wearer.

The current technical for shaping is mainly to use different yarn loop structure with long float stitch, higher denier or high draft of elastic fiber; or to apply a special silhouette pattern in strategically selected areas. Other common practice includes introducing second layers of fabric or pad sewn with base fabric, or selecting the fabrics with different elasticity and sewing together in different positions (Sun W., U.S. Pat. No. 7,950,0669B2; Costa, F., WO2013/154445A1; James S., US2010/0064409A1; Frank Z., US2011/0214216A1; Stewart M., GB2477754A; Lori H., U.S. Pat. No. 7,341,500B2; Nicolas B., U.S. Pat. No. 7,945,970B2; Fujimoto M., EP 0519135B1). For example, a special designed rigid panel is added inside of jean in front of belly to help slenderize the stomach. A piece of padding or sponge is inserted into trousers to lift and enhance a visual buttock profile of the wear. All these methods compromise the wearers' comfort for offering the shaping effect and are visible from the garment surface.

Polymer compositions such as polyurethaneurea films and tapes that provide stretch recovery are disclosed in U.S. Pat. No. 7,240,371. Carmen C. et al disclosed a method to add polymer composition on the edge of garments to form the garment edge bands and to add film on garments such as brassiere to form laminate fabrics in patent EP 2280619B1 and US2009/0181599A1. Disclosed are fabric laminates or fabric bands having multiple layered structures, including at least one fabric layer and at least one polymer layers that have been attached or bonded together. The dispersed polymer particles are connected together and form film on the fabric surface, which is visible and touchable in use. Such film or film-alike flat polymer layer makes un-favorable fabric appearance, tactile and air permeate ability. Other examples of polymer compositions are polyurethane tapes such as those commercially available from Bemis, and polyolefin resins that can be formed into films such as those commercially available from ExxonMobil under the trade name VISTAMAXX. These films may be bonded to fabric with application of heat.

SUMMARY OF THE INVENTION

A garment that provides an invisible shaping function with comfort as well as performance is still highly desirable.

On aspect provides a garment that includes an elastic base fabric region and at least one fabric composite zones with shaping and slimming features. The shaping and slimming function is achieved by applying elastic polymer composition to one side of the base fabrics in the fabric composite zone. The elastic polymer composition penetrates into the fabric inside, bonds with fibers and yarns to form a single layer of integrated fabric characterized with fiber-dominated surface covered by discontinuous polymer particles. Where garment has an inner and outer surface, applying the elastic polymer composition to an inner surface of a garment can prevent detection of the polymer composition from the outer surface of the garment. An elastomeric polymer composition is a polymer selected from the group consisting of elastomeric polyolefins, polyurethanes, and polyurethaneureas. The fabric composite is breathable, washable and substantially invisible from the face/outer surface of the garment.

The fabric composite zone is used as shaping or reinforcing region of the garment in targeted locations. This is where the polymer composition with low solids content is applied from the back/inner surface of fabric, and evenly penetrates inside the fabric body, without going through to the outer side of the base fabric or garment. The polymer composition separately distributes and settles in the spaces and gaps between fibers and yarns within the fabric. After heat activation, polymer molecular form elastic connection bridges between fibers and yarns and bond them together. In such shaping regions, the fabrics have higher stretch modulus and higher retraction force in the fabric composite zones, which limit the fabric deformation as compared with base elastic region as human body movement. According the garment shape can be strategically relocated and result in shaping effects during wearing.

Unlike film or fabric laminate in prior arts, within the innovation fabric, the polymer composition doesn't form film or a continuous flat surface. When dispersion is used, the divided polymers particles are discontinuously placed and separated penetrate into the fabric body, which avoid the unpleased shining and rubbery touch surface. The polymer is also invisible from outside of garment with good breath ability.

The elastic polymer particles are attached by a variety of methods including heat/bonding, spread, paint, brush, print. The fabric may be woven, circular knit or warp knit. The polymer composition may be applied as a melt or dispersion. The polymer compositions may be used in a variety of garment constructions including jeans and pants.

The base fabric itself is a stretch fabric including one or more elastic yarns. Suitable elastic yarns include, but are not limited to, polyester bicomponent and elastane/spandex. The inclusion of the polyurethaneurea composition imparts benefits of elasticity and shape retention to either type of fabric. They can be used in a variety of different garment constructions e.g. active wear, sportswear, intimate apparel and ready to wear, such as jeans.

A garment with shaping function is provided by applying elastic polymer in divided particles form in targeted areas, The elastic polymer composition may be applied to the fabric prior to garment preparation, to the garment or to both the fabric and garment. The polymer content is about 1% and to about 30% of base fabric weight. The extension modulus in stretch direction in shaping zone is at least 10% higher than in comfort base zone. The holding force of cured fabric in shaping zone is at least 15% higher than the fabric in fabric composite zone compared to the base fabric.

Further provided is a garment with localized shaping effect by applying elastic polymer in targeted areas. The shaping regions locate one or some areas to make body figures more attractive: in front of belly of the body, along the inner and outer sides of a thigh of a wearer, around knee region, around buttock area in the rear part of body, also referred to as the seat.

Methods for making a garment with shaping ability are also provided. The process includes: selecting fabric with 15% or higher stretch as base fabric; applying elastic polymer composition on the fabric; bonding the polymer with fabric through drying or curing; optionally washing the fabric before wearing.

DETAILED DESCRIPTION OF THE INVENTION

Figure 1:
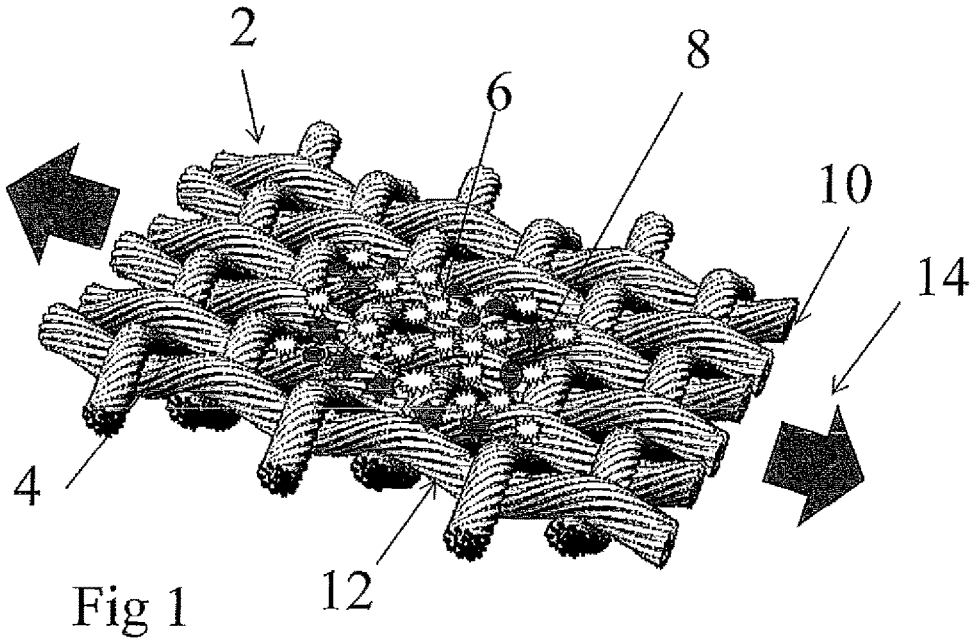
FIG. 1 is an illustrated fabric with shaping composite zone which comprises the discontinuous elastic polymer particles.

Garments of some aspects are advantageously constructed with areas of fabric composite at specific locations to provide shaping and slimming features. As used herein, the term 'fabric composite' preferably comprises, for example, elastic base fabric applied with elastic composite polymer, which is stretchable and breathable, yet has highly resilient and shaping properties. The polymer particles discontinuously locate and stick with fibers and yarns, and separately penetrate into fabric body. Exemplary materials from which base fabric may be made include spandex, bi-component polyester fiber and any fiber composites incorporating elasticized and/or resilient properties.

As used herein, the term "film" means a flat, generally two-dimensional article. The film may be self-supporting such as a film that has been cast and dried or extruded. Alternatively, the film may be a melt, dispersion or solution.

As used herein, the term "pressing" or "pressed" refers to an article that has been subjected to heat and/or pressure to provide a substantially planar structure.

As used herein, the term "dispersion" refers to a system in which the disperse phase consists of finely divided particles, and the continuous phase can be a liquid, solid or gas.

As used herein, the term "aqueous polyurethane dispersion" refers to a composition containing at least a polyurethane or polyurethane urea polymer or prepolymer (such as the polyurethane prepolymer described herein), optionally including a solvent, that has been dispersed in an aqueous medium, such as water, including de-ionized water.

As used herein, the term "solvent," unless otherwise indicated, refers to a non-aqueous medium, wherein the non-aqueous medium includes organic solvents, including volatile organic solvents (such as acetone) and somewhat less volatile organic solvents (such as MEK, or NMP). As used herein, the term "solvent-free" or "solvent-free system" refers to a composition or dispersion wherein the bulk of the composition or dispersed components has not been dissolved or dispersed in a solvent.

As used herein, the term "fabric" refers to a knitted, woven or nonwoven material. The knitted fabric may be flat knit, circular knit, warp knit, narrow elastic, and lace. The woven fabric may be of any construction, for example sateen, twill, plain weave, oxford weave, basket weave, and narrow elastic. The nonwoven material may be melt blown, spun bonded, wet-laid, carded fiber-based staple webs, and the like.

As used herein, the term "hard yarn" refers to a yarn which is substantially non-elastic.

As used herein, the term "molded" article refers to a result by which the shape of an article or shaped article is changed in response to application of heat and/or pressure.

As used herein, the term "derived from" refers to forming a substance out of another object. For example, a film may be derived from a dispersion which can be dried.

Elastomeric fibers are commonly used to provide stretch and elastic recovery in fabrics and garments. "Elastomeric fibers" are either a continuous filament (optionally a coalesced multifilament) or a plurality of filaments, free of diluents, which have a break elongation in excess of 100% independent of any crimp. An elastomeric fiber when (1) stretched to twice its length; (2) held for one minute; and (3) released, retracts to less than 1.5 times its original length within one minute of being released. As used in the text of this specification, "elastomeric fibers" means at least one elastomeric fiber or filament. Such elastomeric fibers include but are not limited to rubber filament, biconstituent filament (which may be based on rubber, polyurethane, etc.), lastol, and spandex. The terms "elastomeric" and "elastic" are used interchangeably throughout the specification.

"Spandex" is a manufactured filament in which the filament-forming substance is a long chain synthetic polymer comprised of at least 85% by weight of segmented polyurethane. "Elastoester" is a manufactured filament in which the fiber forming substance is a long chain synthetic polymer composed of at least 50% by weight of aliphatic polyether and at least 35% by weight of polyester. Although not elastomeric, elastoester may be included in some fabrics herein.

"Polyester bi-component filament" means a continuous filament comprising a pair of polyesters intimately adhered to each other along the length of the fiber, so that the fiber cross section is for example a side-by-side, eccentric sheath-core or other suitable cross-section from which useful crimp can be developed. The polyester bicomponent filament comprises poly(trimethylene terephthalate) and at least one polymer selected from the group consisting of poly(ethylene terephthalate), poly(trimethylene terephthalate), and poly (tetramethylene terephthalate) or a combination of such members, having an after heat-set crimp contraction value of from about 10% to about 80%.

In accordance with a third aspect, there is provided a method of manufacture of a shaping garment, characterized by comprising the steps of: selecting a suitable stretch fabric as a base fabrics; designing the shaping zone where the elastic polymer composite is applied and offer shaping function with heavily-stretch characters; applying the polymer composition in accurate and efficient manner; Curing the articles in suitable temperature and time for firmly fixation of composite polymer with base fabric.

When elastic polymer composition with low content of solid particle is put on the back of base fabric, the polymer particle can penetrate into the inside of fabric, but fail to penetrate through to the outer surface of the fabrics. After drying, the water evaporate, the solid articles remain inside fabric in the way that it stays in the gap spaces between the fibers and yams. After curing, the solid polymer particles bond together with fiber or with some of neighbor polymer particles.

The polymer can stand the repeat wash in fabric and garment finishing process and home laundry. They are invisible or substantially invisible and untouchable from the back and the surface of the fabric.

FIG. 1 illustrates a detailed innovation fabric structure within a garment with shaping function. The fabric 2 contains two parts: base fabric region 4 without polymer composition and fabric composite zone 6 infused with polymer composite 8. The base fabric is a stretch fabric constituted with yarns 12 comprised with hard fiber and elastic fiber 10. The stretch fabric can be stretched out in the direction 14. The elastic polymer composition 8 is disposed in one side of the fabric, penetrates into the interior of the fabric through the gap and porous spaces between the yarns and fibers, bounds with fiber and form a single layer of integrated fabric composite identity. The surface of the fabric composite is majorly dominated with fibers covered by discontinuous elastic polymer particles. The elastic polymer composition forms a don't connect together and don't form a film or a lay of flat surface on the back of fabric. The elastic polymer composition is invisible from the surface of the fabric.

Figure 2:
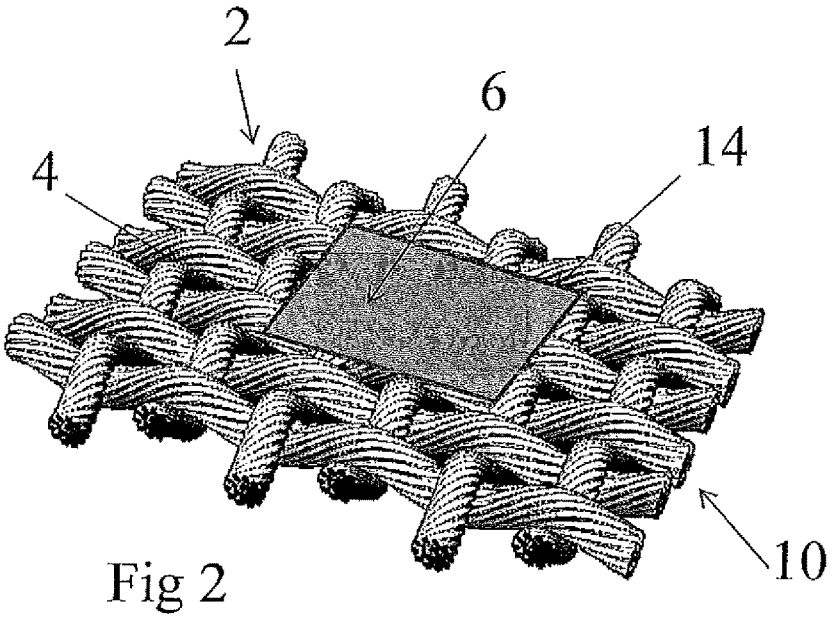
FIG. 2: is an illustrated fabric with shaping composite zone which comprises the continuous elastic polymer compositions, such as filament or laminate.

FIG. 2 shows the fabric structure of garment in prior art, where a film or a continuous layer of fabric laminate 16 is disposed on the surface of a fabric, where the shining look and rubbery touch exist.

Figure 3:
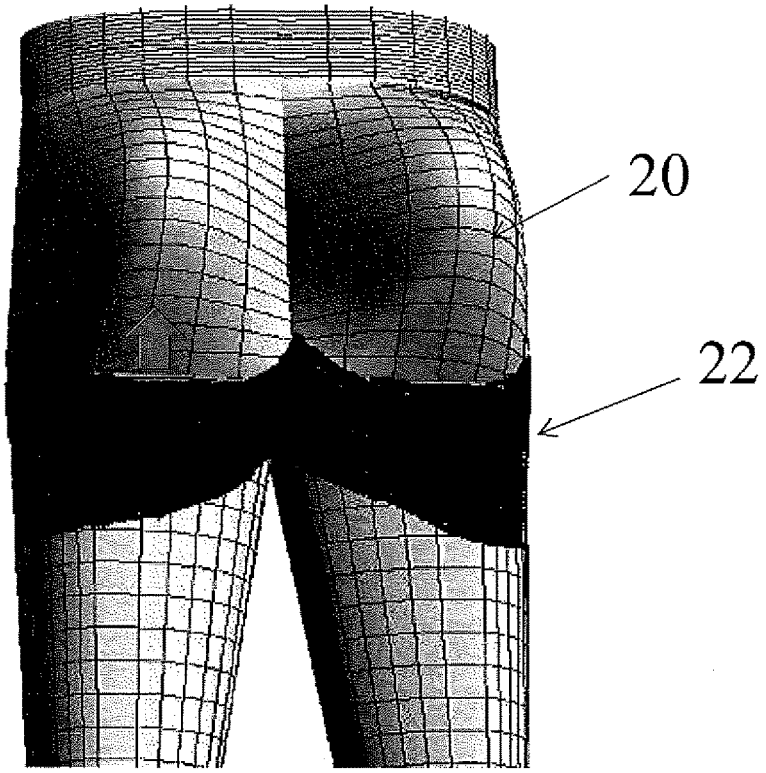
FIG. 3 is an illustrated garment including the elastic polymer composition in seat-lift zone, where the fabric composite covers the rear portion of the wearer's body in the lower part of the buttock and the upper portion of the thigh.

FIG. 3 demonstrates a garment 20 comprising a pair of legging with fabric composite around seat lift zone. The base fabric 2 is a stretch fabric which may contain elastane fiber so as to allow a degree of stretch. The base fabric may be a resilient nature so as to provide a measure of all over support to wearer. The garment also comprises shaping region 22, over which the elastic polymer composition is placed to the base fabric. The polymer is preferable is a dispersion. The polymer is applied to an inner side of the base fabric using a technique that involve the application and heat and may also involve elevated pressure. Such techniques closely bond the polymer with fabric together, enabling them to perform as invisible shaping function. In this way the garment can provide support and shaping to the wearer in an invisible manner, and without the extra bulk of a separated undergarment or a layer of film or laminate that can show through a thin or close fitting pant, such as legging.

It was surprised to find that the dispersion with optimum solid content can penetrate into the inside of the base fabric, but will not go through the entire fabric and don't show up in the surface of the fabric. From the fabric surface, the polymer is invisible and untouchable. The polymer is hidden during garment is worn. After dry and heating process, the elastic polymer composition infuses into the base fabric and binds together with yarn and fiber to form shaping fabric composite, which is stiffer than base fabric. Meanwhile, the fabric composite still has the elasticity with high holding force. The portion of the human body surface to which the shaping zone is applied is subjected to a tightening force, and therefore the difference between said fabric composite surface and the base fabric surface portions appears because of the pressure difference. This fabric composite in shaping zone may act to the shape of the body contours and to smooth or control the display of some of the key areas. The shaping fabric composite region may thus be tailored to extend over only those regions where it is desired.

It will be appreciated that the shaping zone is not located all over the garment, so as to produce an allover squeeze but is provided in carefully selected areas. The results of the positioning of the shaping zone is to provide support and shaping to the contours of the body, slimming the thighs, lifting the buttocks and flattening the abdomen, thus creating an improved silhouette rather than simply constricting the entirely of the lower body.

In some aspects, the shaping fabric composite is placed in butt-up zone also referred to as "seat-lift", as shown in FIG. 3, where the fabric composite covers rear portion of the wearer's body in the lower part of the buttock and the upper portion of the thigh. The composite fabric in seat-lift zone pushes the wearer's hips up, so as to make contours of the seat/rear more voluminous. The butt-up band pushes the seat up in arrow direction in FIG. 3, so as to tighten the seat area. As shown in FIG. 3, the seat-lift band 22 is symmetric with respect to the center portion of the elastic fabric 20 to push the buttocks up in the arrow direction. The shaping fabric composite zone supports lower portions of the buttocks upward in the arrow direction. The shape of the seat lift band 22, such as a curvature or a width of the band 22, can be modified.

Figure 4:
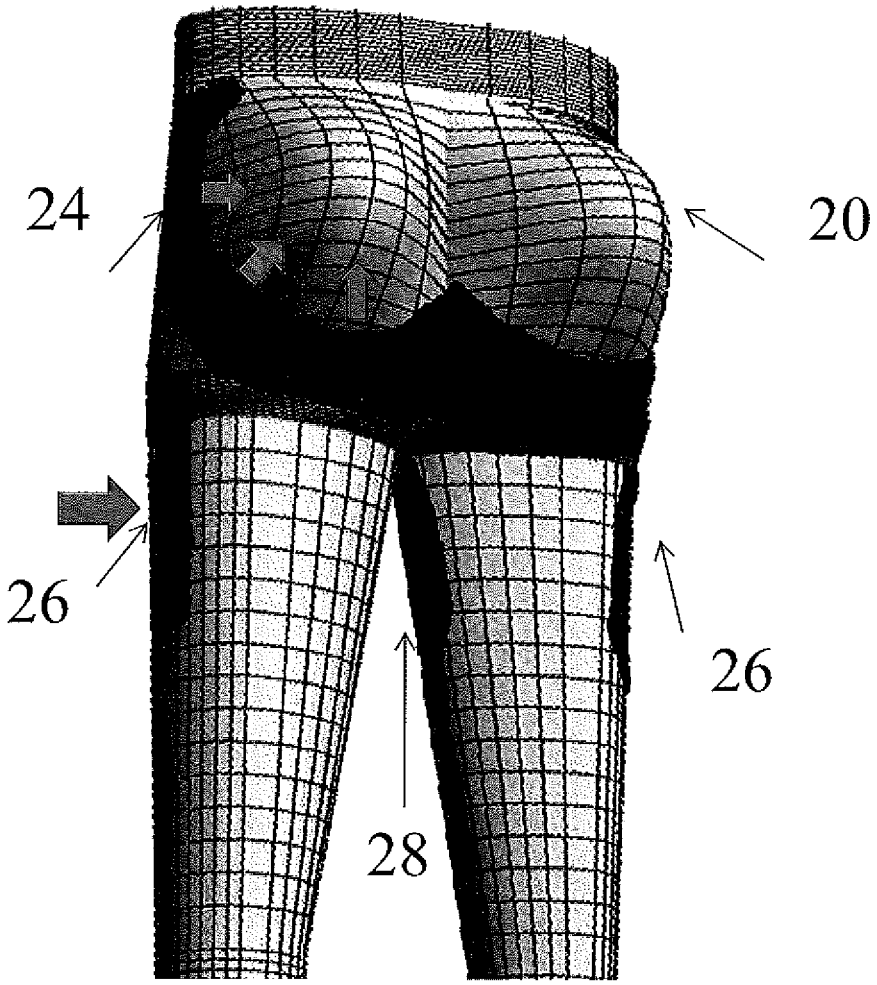
FIG. 4 is an illustrated garment including the elastic polymer composition in buttocks-shaping zone, where the fabric composite is arranged in the rear portion of the wearer's body around the buttock area as a curved U shape.

In some aspects, the shaping fabric composite zone is applied in Butt Shaping zone, as shown in FIG. 4. The shaping fabric composite is arranged around the buttock as a curved U shape. The Butt-shaping band 24 may push the buttocks of the wearer up and concentrates the buttocks so as to make the contours of the buttocks look more rounded and elevated. It pushes both sides of the buttocks so that sides of the hips do not protrude and voluminous buttocks contours can be shown. Referring to FIG. 4, the butt-shaping band 24 is symmetrically. The seat-lifting/buttocks-shaping shaping band pushes the hips of the wearer up in an arrow direction and includes the pocket portion, and tightens the buttocks in the arrow direction.

Figure 5:
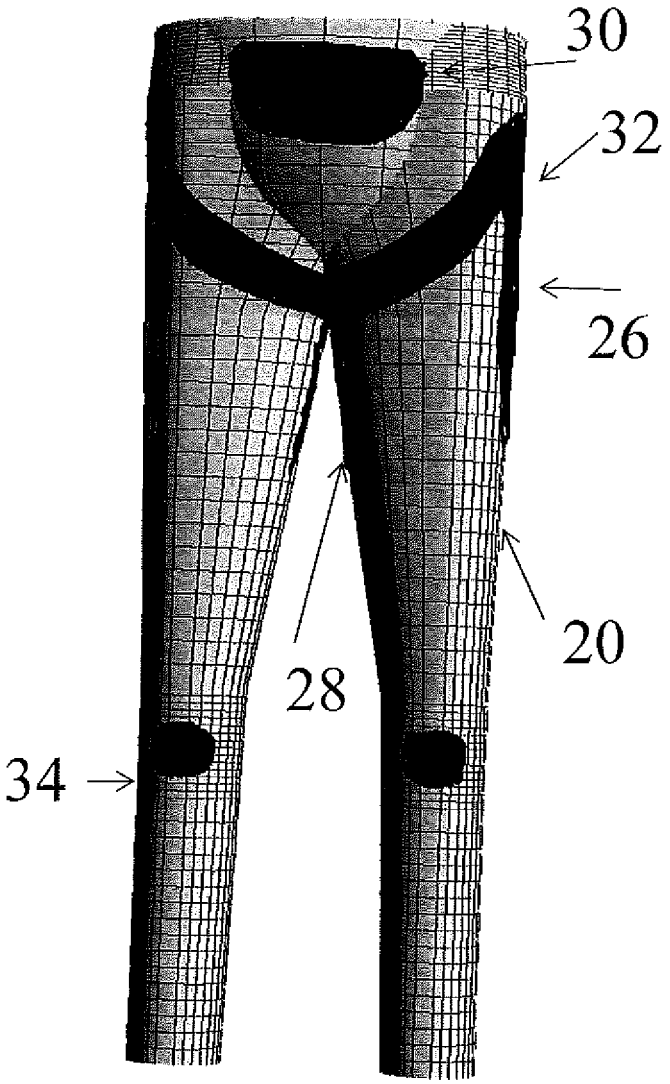
FIG. 5 is an illustrated garment including the elastic polymer composition in tummy-tighten zone and thigh-slenderizing zone, where the fabric composite is disposed in front of tummy and around outer and inner thigh of a jean.

In some aspects, the shaping fabric composite zone is placed in Thigh Slenderizing zone: The Shaping zone 26 and 28 are applied in inside of thigh, or/and outside of the thigh areas of the wearers, from a knee region to a crotch region and from a knee region to a hip region, as shown in FIG. 4 and FIG. 5. This shaping zone 26 and 28 may act as to slim thigh and to lift the buttock. As described above, the compression bands 26 and 28 push and carve out the outer and inner portion of the thighs of the wearer in the arrow direction c to make the thighs look thin, smooth and slim.

In some aspects, the shaping fabric composite zone is implemented in Tummy Flatter zone, as shown in FIG. 5. The composite fabric 30 is placed to cover abdominal portion of the wearers. In use, at least one shaping region may extend across the lower abdomen of a wearer from a waist region to a crotch region. In some embodiments, the fabric composite is applied as a band 32 in front portion of the pant, from hip to crotch area. The shaping zones may thus act to flatten the lower abdomen of a wearer. It eliminates excess bulging, provides core stability and promotes body awareness, while providing a smooth look all around and providing abdominal compression while enhancing the posture of the wearer. For a figure hugging fit, the fabric composite zone 30 lifts and defines wear's body and gives wearer a beautiful, shaped silhouette. In some embodiments, the shaping composite fabric is disposed in front of knee area. While the composite fabric keep the pants leg straight and slack, it also provide better abrasion resistance and high fabric strength to improve the garment durability in this area.

Figure 6:
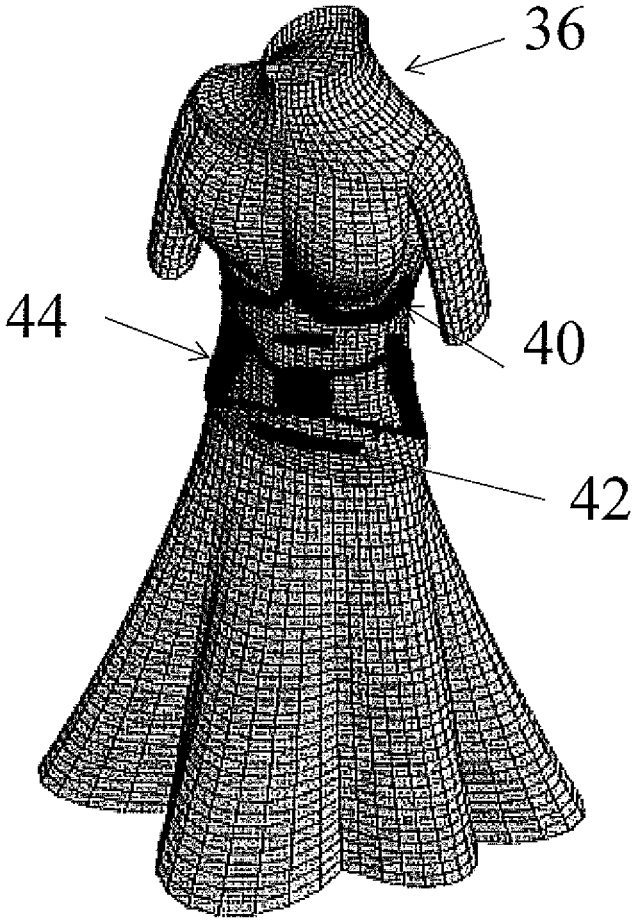
FIG. 6 is an illustrated garment including the elastic polymer composition in belly-slimming zone, where composite fabric is placed in front of belly of a top wear.

In some embodiments, the fabric composite is arranged in Abdomen Tighten zone 42 (i.e., tummy flattening), around waist area 44, and in front of abdomen 40 on the top garment, as shown in FIG. 6. Through the higher holding force of fabric composite in this area, the wear's waist may look as narrower.

The shapes of the shaping composite fabric can be modified variously to shape the hips and thighs using the above method. Although illustrative embodiments of the present invention have been described herein with reference to the accompanying drawings, it is to be understood that the present invention is not limited to those precise embodiments, and that various other changes and modifications may be affected therein by one skilled in the art without departing from the scope or spirit of the present invention. All such changes and modifications are intended to be included within the scope of the invention as defined by the appended claims.

Figure 7:
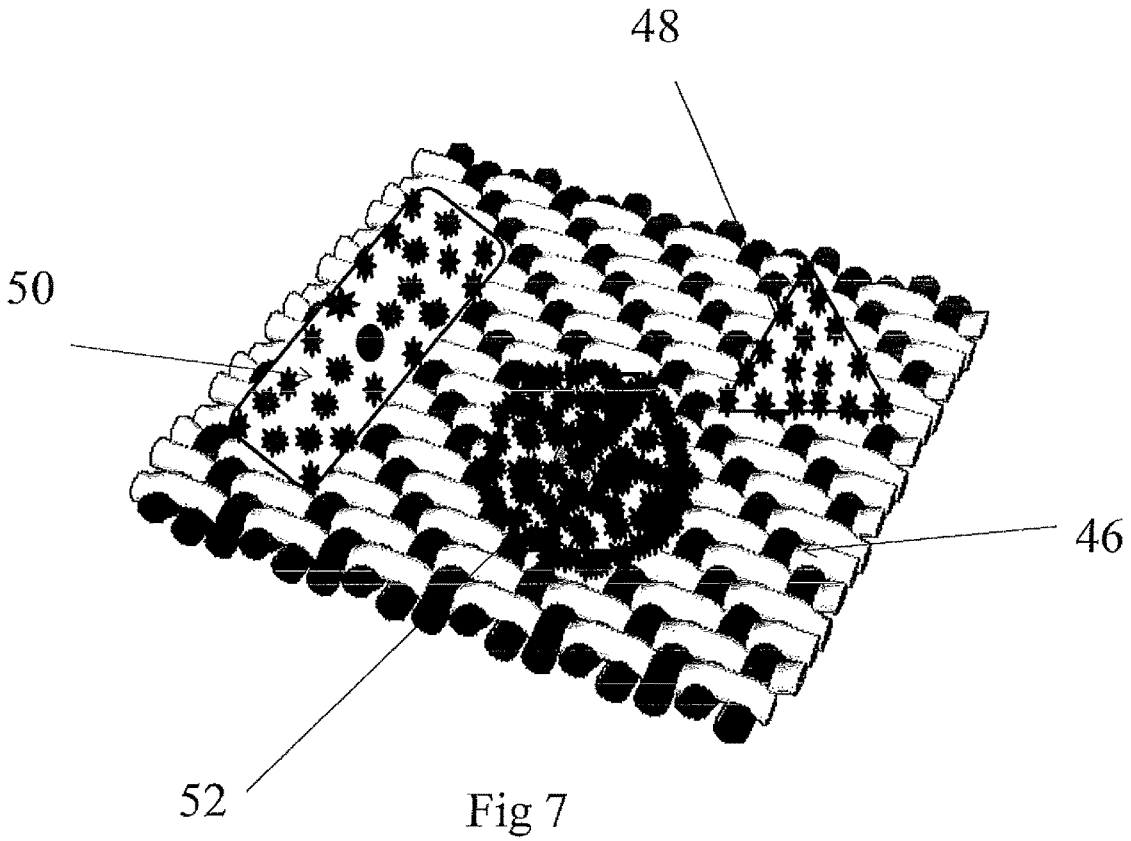
FIG. 7 is an illustrated fabric with fabric composite zone which comprises the discontinuous elastic polymer particles. The fabric composite zone is made up by various shapes and figures.

It will be appreciated that the garment may comprise more than one shaping region, for example, thigh slenderizing, tummy flattening, and seat-lift (raising the buttocks) zone, thus slimming the thighs, lifting the buttocks and flattening the lower abdomen. The support regions may connect and or be integrally formed or they may be discrete areas of the garment. The elastic polymer composition may be put on garment to form various figure shapes to add functional and beauty effects. FIG. 7 illustrates some of the shapes and figures, such as triangle 48, lines 50, dot 52 and others.

The composite fabric may be in inner surface of the base fabric, such as, in use, the composite is adjacent a wearer's body. The composite thus remain hidden when the garment is being worn.

It is important to use elastic fabrics as base fabric, which provide comfort and movement freedom for wearers. Elastomeric fibers, such as spandex, polyester bi-component fiber, are incorporated into the fabric to provide greater stretch and to improve comfort and fit. In some embodiments, the base fabric has at least 15% stretches. The fabric has good recovery. The fabric could be woven, circular knit, warp knit, jean and khakis. The weight of base fabric could be from 3.0 OZ/Yard$^2$ to 15 Oz/Yard$^2$. For pants and jeans, 3/1 twill structure is often used, but other fabrics structures, wovens, including other twills are useful.

A variety of different fibers and yarns may be used with the fabrics and garments of some embodiments. These include cotton, wool, acrylic, polyamide (nylon), polyester, spandex, regenerated cellulose, rubber (natural or synthetic), bamboo, silk, soy or combinations thereof.

A variety of different polyurethane compositions are useful with the solutions and dispersions of some embodiments. For example, in some embodiments, an aqueous dispersion, or a substantially solvent free aqueous dispersion may be used as composition. Many such solutions or dispersions are known in the art such as those shown in U.S. Pat. No. 7,240,371. An example of a polyurethaneurea solution is a spinning solution from a commercial spandex production line may be used, according to some embodiments. Specific examples of aqueous dispersion are described hereinbelow.

Depending on the desired effect of the polyurethaneurea composition of some embodiments when applied as a dispersion from the aqueous dispersion described herein, the weight average molecular weight of the polymer may vary from about 40,000 to about 150,000, including from about 100,000 to about 150,000 and about 120,000 to about 140,000. Other additives that may be optionally included in the aqueous dispersion or in the prepolymer include: antioxidants, UV stabilizers, colorants, pigments, crosslinking agents, phase change materials (i.e., Outlast®, commercially available from Outlast Technologies, Boulder, Colorado), antimicrobials, minerals (i.e., copper), microencapsulated wellbeing additives (i.e., aloe vera, vitamin E gel, aloe vera, sea kelp, nicotine, caffeine, scents or aromas), nanoparticles (i.e., silica or carbon), calcium carbonate, flame retardants, antitack additives, chlorine degradation resistant additives, vitamins, medicines, fragrances, electrically conductive additives, and/or dye-assist agents (i.e., Methacrol®, commercially available from E. I. DuPont de Nemours, Wilmington, Del.). Other additives which may be added to the prepolymer or the aqueous dispersion comprise adhesion promoters, antistatic agents, anti-cratering agents, anti-crawling agents, optical brighteners, coalescing agents, electroconductive additives, luminescent additives, flow and leveling agents, freeze-thaw stabilizers, lubricants, organic and inorganic fillers, preservatives, texturizing agents, thermochromic additives, insect repellants, and wetting agents. Such optional additives may be added to the aqueous dispersion before, during, or after the prepolymer is dispersed, as the process allows. Similarly, these additives may be included with any other elastomeric polymer composition including polyolefins and polyurethanes.

Unexpectedly, it was found that when the polymer solid content is between about 5% to about 30% of base fabric weight in fabric composite zone, the polymer composition may dispose on the fabric as a discontinuous form. The polymer particles evenly penetrate inside the fabric body, but don't go through the outer side of the base fabric. The polymer compositions separately distribute and locate in the spaces and gaps between fibers and yarns within the fabric. Both front and back side of the fabric are covered by fiber and yarns. From back of the fabric, the polymer composition is substantially invisible and untouchable. From front surface, the polymer composite can't be seen. There is no noticeable difference of the fabric surface appearance between base fabric region and fabric composite regions.

In the polymer composition, when the polymer solid content is lower than 5%, the fabric composite is unable to deliver sufficient shaping performance. When the polymer solid content is higher 30% of the base fabric weight, the appearance and touch feel of the fabric composite has noticeable change, strong rubbery and harsh touch and shining appearance. Accordingly, a suitable solids content can be from about 5% to about 30% of the dispersion, including about 10% to about 25%.

The good practices to obtain suitable solid content within fabric are to use polyurethane aqueous dispersions. Unlike film, the solid content of aqueous polyurethane dispersion can be easily adjusted during use. So a wide range of fabrics can be produced with various performances, from soft hand to high rigid fabrics. A convenient and economical way is to use dispersion with low content of solid particles, so as the divided polymer particles could easily penetrate into fabric inside and do not form continuous film's lay on the surface of the fabric. In order to obtain high content of solid polymer particles, more dispersion or more coating times could be applied. By applying more dispersion with low solid particles, better penetration can be achieved.

Polyurethane aqueous dispersions useful in some aspects should be expected to have a solids content of from about 10% to about 40% by weight, for example from about 10% to about 35% by weight. The viscosity of polyurethane aqueous useful in some aspects may be varied in a broad range from about 10 centipoises to about 100,000 centipoises depending on the processing and application requirements.

For example, in one embodiment, the viscosity is in the range of about 500 centipoises to about 30,000 centipoises. The viscosity may be varied by using an appropriate amount of thickening agent, such as from about 0 to about 2.0 wt %, based on the total weight of the aqueous dispersion.

An organic solvent may also be used in the preparation dispersions of some embodiments. The organic solvent may be used to lower the prepolymer viscosity through dissolution and dilution and/or to assist the dispersion of solid particles of the diol compound having a carboxylic acid group such as 2,2-dimethylopropionic acid (DMPA) to enhance the dispersion quality. It may also serve for the purposes to improve the uniformity.

The solvents selected for these purposes are substantially or completely non-reactive to isocyanate groups, stable in water, and have a good solubilizing ability for DMPA, the formed salt of DMPA and triethylamine, and the prepolymer. Examples of suitable solvents include N-methylpyrrolidone, N-ethylpyrrolidone, dipropylene glycol dimethyl ether, propylene glycol n-butyl ether acetate, N,N-dimethylacetamide, N,N-dimethylformamide, 2-propanone (acetone) and 2-butanone (methylethylketone or MEK).

The amount of solvent added to the dispersion of some embodiments may vary. When a solvent is include, suitable ranges of solvent include amounts of less than 50% by weight of the dispersion. Smaller amounts may also be used such as less than 20% by weight of the dispersion, less than 10% by weight of the dispersion, less than 5% by weight of the dispersion and less than 3% by weight of the dispersion.

There are many ways to incorporate the organic solvent into the dispersion at different stages of the manufacturing process, for example, 1) The solvent can be added to and mixed with the prepolymer after the polymerization is completed prior to transferring and dispersing the prepolymer, the diluted prepolymer containing the carboxylic acid groups in the backbone and isocyanate groups at the chain ends is neutralized and chain extended while it is dispersed in water.
2) The solvent can be added and mixed with other ingredients such as Terathane® 1800, DMPA and Lupranate® MI to make a prepolymer in the solution, and then this prepolymer containing the carboxylic acid groups in the backbone and isocyanate groups at the chain ends in the solution is dispersed in water and at the same time it is neutralized and chain extended.
3) The solvent can be added with the neutralized salt of DMPA and Triethylamine (TEA), and mixed with Terathane® 1800 and Lupranate® MI to make the prepolymer prior to dispersion.
4) The s solvent can be mixed with TEA, and then added to the formed prepolymer prior to dispersion.
5) The solvent can be added and mixed with the glycol, followed by the addition of DMPA, TEA and then Lupranate® MI in sequence to a neutralized prepolymer in solution prior to dispersion.

Figure 8:
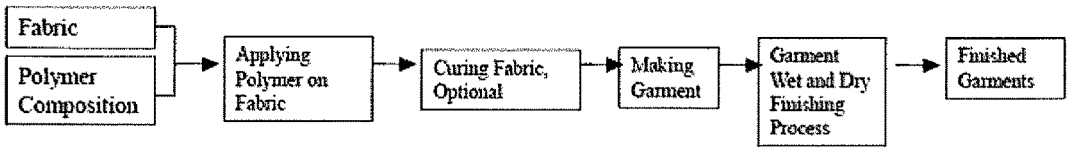
FIG. 8 is a flowchart showing the processing steps that may be used to apply elastic polymer composition before garment making.
Figure 9:
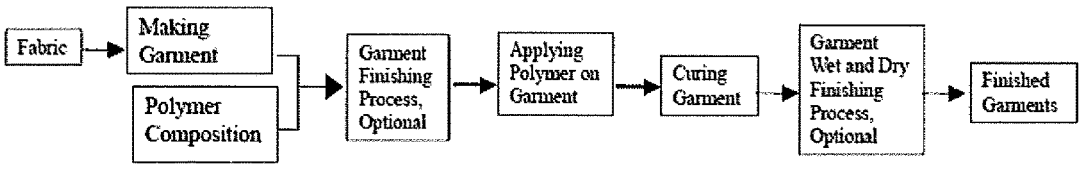
FIG. 9 is a flowchart showing the processing steps that may be used to apply elastic polymer composition during and after garment making.

FIG. 8 and FIG. 9 are the flowcharts showing the processing steps that may be used to apply dispersion to the garment before and after garment making. The elastic polymer compositions may be applied on to fabric in predetermined areas before garment making (FIG. 8). Whole width fabric or fabric panels may be used. After polymer composition added, the fabric may be cured at elevated temperature before assembling to garment, or cured after garment making. Then entire piece of garment goes through dry and wet laundry process.

Another aspect (FIG. 9) is to apply the polymer composition after garment making, or during garment finish processing, or after garment finishing process. Curing process may be needed after applying the compositions. Extra wash or laundry processing may be used after polymer application to make garment clearer. In some embodiments, iron or steam iron is used to fix the composition with fabrics instead of curing procedure.

Methods and means for applying the polymer compositions of some embodiments include, but are not limited to: roll coating (including reverse roll coating); use of a metal tool or knife blade (for example, pouring a dispersion onto a substrate and then casting the dispersion into uniform thickness by spreading it across the substrate using a metal tool, such as a knife blade); spraying (for example, using a pump spray bottle); dipping; painting; printing: stamping; and impregnating the article. These methods can be used to apply the dispersion directly fabric without the need of further adhesive materials and can be repeated if additional/heavier layers are required.

One suitable method for accomplishing the application of the elastomeric polymer composition to a garment is to apply a dispersion or solution to a fabric in targeted areas. The application may be by any of a variety of different methods. Methods for applying the dispersions or solutions of elastomeric polymer include spraying, kissing, printing, brushing, dipping, padding, dispensing, metering, painting, and combinations thereof. This may be followed by application of heat and/or pressure.

The water in the dispersion can be eliminated with drying during the processing (for example, via air drying or use of an oven), leaving the precipitated and coalesced polyurethane layer on the fabrics to form a composite shaping fabric.

At least one coagulant may optionally be used to control the penetration of dispersions into a fabric or other article. Examples of coagulants that may be used include calcium nitrate (including calcium nitrate tetrahydrate), calcium chloride, aluminum sulfate (hydrated), magnesium acetate, zinc chloride (hydrated) and zinc nitrate.

Any type of fabric may be used as the shaping garment of some embodiments. This includes woven, knit, and lace fabrics, among others. The elastomeric polymer may be placed adjacent to one surface of the shaping garment. The polyurethaneurea composition may be incorporated into the garment during construction of the garment. Dyeing and finishing of the garment may be conducted before or after assembly of the garment with shaping effect with the elastomeric polymer composition.

There are some benefits to include the fabric and polymer composition prior to fabric finishing. One example is where in a denim fabrics, including tend to shrink upon fabric finishing. During wear of the garment, growth tends to occur. By including an elastomeric polymer film in the shaping area, growth of the fabric is resisted in addition to the benefits of added elasticity. The garment dyeing and finishing processes improve the elastic properties including the modulus of the polymeric film composition.

Curing process under high temperature could increase the adhesion bonding of polymer composition with fabrics. Curing also could enhance the properties of composition materials, such elasticity, recovery power, shape retention and durability. The adhesion bonding can be developed in the temperature range of from about 100° C. to about 200° C., such as from about 130° C. to about 200° C., for example, from about 140° C. to about 180° C., in a period of 0.1 seconds to several minutes, for example, less than about one minute.

Bonding with press is also able a way to adhere the elastomeric polymer composition to the fabric, The elastomeric polymer composition may be applied directly as a dispersion, melt or solution, followed by cooling or drying. For bonding, pressure, heat, or a combination of pressure and heat is applied to the garment. For example, heat may be applied at about 150° C. to about 200° C. or about 180° C. to about 190° C., including about 185° C. for a sufficient time to achieve a molded article. Suitable times for application of heat include, but are not limited to, from about 30 sec to about 360 sec including from about 45 sec to about 120 sec. Bonding may be effected by any known method, including but not limited to, microwave, infrared, conduction, ultrasonic, pressure application over time (i.e. clamping) and combinations thereof.

Due the application of heat and pressure to the fabric or garment including elastomeric polymer or dispersion and given that fabrics are themselves porous materials, it is recognized that the dispersion may partially or completely impregnate the fabric. For example, the elastomeric polymer composition may be completely transferred to fabrics to form an integrated article without a distinguishably separate elastomeric fabric composite.

The coating, dispersion, or composite shaping fabric may be pigmented or colored and also may be used as a design element in that regard.

In addition, garments including shaping area can be molded. For example, fabric can be molded under conditions appropriate for the hard yarn in the fabric. Also, molding may be possible at temperature which will mold the shaped article or dispersion, but below temperatures suitable for molding the hard yarn.

Due to the existing of elastic polymer composition, fabric composite area can provide the ability to improve durability, abrasion resistance and see-through prevention abilities, in addition to shaping function.

Examples of apparel or garments that include a shaping area that can be produced using the dispersions and shaped articles falling within the scope of the present invention, include but are not limited to: jeans, pants, khakis, leggings, blouses, etc.

Analytical Method

In the examples that follow, the following analytical methods were used.

Fabric Elongation (Stretch)

Fabrics are evaluated for % elongation under a specified load (i.e., force) in the fabric stretch direction(s), which is the direction of the composite yarns (i.e., weft, warp, or weft and warp). Three samples of dimensions 20 cm×6.5 cm were cut from the fabric. The long dimension (25 cm) corresponds to the stretch direction. The samples are partially unraveled to reduce the sample widths to 5.0 cm. The samples are then conditioned for at least 16 hours at 20° C.+/−2° C. and 65% relatively humidity, +/−2%.

A first benchmark was made across the width of each sample, at 6.5 cm from a sample end. A second benchmark was made across the sample width at 20.0 cm from the first benchmark. The excess fabric from the second benchmark to the other end of the sample was used to form and stitch a loop into which a metal pin could be inserted. A notch was then cut into the loop so that weights could be attached to the metal pin.

The sample non-loop end was clamped and the fabric sample was hung vertically. A 17.8 Newton (N) weight (4 LB) is attached to the metal pin through the hanging fabric loop, so that the fabric sample is stretched by the weight. The sample was "exercised" by allowing it to be stretched by the weight for three seconds, and then manually relieving the force by lifting the weight. This cycle was carried out three times. The weight was allowed then to hang freely, thus stretching the fabric sample. The distance in millimeters between the two benchmarks was measured while the fabric was under load, and this distance is designated ML. The original distance between benchmarks (i.e., unstretched distance) was designated GL. The % fabric elongation for each individual sample as calculated as follows:

$$\%\ \text{Elongation}\ (E\ \%)=((ML-GL)/GL)\times 100$$

The three elongation results were averaged for the final result.

Fabric Growth (Unrecovered Stretch)

After stretching, a fabric with no growth would recover exactly to its original length before stretching. Typically, however, stretch fabrics will not fully recover and will be slightly longer after extended stretching. This slight increase in length is termed "growth."

The above fabric elongation test must be completed before the growth test. Only the stretch direction of the fabric was tested. For two-way stretch fabric both directions were tested. Three samples, each 25.0 cm×6.0 cm, were cut from the fabric. These were different samples from those used in the elongation test. The 25.0 cm direction should correspond to the stretch direction. The samples were partially unraveled to reduce the sample widths to 5.0 cm. The samples were conditioned at temperature and humidity as in the above elongation test. Two benchmarks exactly 20 cm apart were drawn across the width of the samples.

The known elongation % (E %) from the elongation test was used to calculate a length of the samples at 80% of this known elongation. This was calculated as $$E\ (\text{length})\ \text{at}\ 80\%=(E\ \%/100)\times 0.80\times L,$$

where L was the original length between the benchmarks (i.e., 20.0 cm). Both ends of a sample were clamped and the sample was stretched until the length between benchmarks equaled L+E (length) as calculated above. This stretch was maintained for 30 minutes, after which time the stretching force was released and the sample was allowed to hang freely and relax. After 60 minutes the % growth was measured as $$\%\ \text{Growth}=(L2\times 100)/L,$$

where L2 was the increase in length between the sample benchmarks after relaxation and L was the original length between benchmarks. This % growth was measured for each sample and the results averaged to determine the growth number.

Wash Test

AATCC test method 150-2001, the entire disclosure of which is incorporated herein by reference, was used for the washing of garments. The machine cycle was (i) normal/cotton sturdy. The washing temp was (111)41° C. The drying procedure was (A)(i) tumble cotton sturdy 66° C. for 30 minutes with a 10 minute cool down time.

Load and Unload Force

Elongation and tenacity properties were measured on fabrics using a dynamic tensile tester Instron. The sample size was 1×3 inches (1.5 cm×7.6 cm) measured along the long dimension. The sample was placed in clamps and extended at a strain rate of 200% elongation per minute until a maximum elongation was reached. The shirting and denim samples are extend from 0 to 20% elongation for three cycles. The knit fabrics are extended from 0 to 50% elongation for five cycles. The load forces and unload forces at 12% or 30% extension were measured after the third cycle.

EXAMPLES

Terathane® 1800 is a linear polytetramethylene ether glycol (PTMEG), with a number average molecular weight of 1,800 (commercially available from INVISTA S.à. r.L., of Wichita, Kans.);

Pluracol® HP 4000D is a linear, primary hydroxyl terminated polypropylene ether glycol, with a number average molecular weight of 400 (commercially available from BASF, Brussels, Belgium);

Mondur® ML is an isomer mixture of diphenylmethane diisocyanate (MDI) containing 50-60% 2,4'-MDI isomerand 50-40% 4,4'-MDI isomer (commercially available from Bayer, Baytown, Tex.);

Lupranate® MI is an isomer mixture of diphenylmethane diisocyanate (MDI) containing 45-55% 2,4'-MDI isomerand 55-45% 4,4'-MDI isomer (commercially available from BASF, Wyandotte, Mich.);

Isonate® 125MDR is a pure mixture of diphenylmethane diisocyanate (MDI) containing 98% 4,4'-MDI isomer and 2% 2,4'-MDI isomer (commercially available from the Dow Company, Midland, Mich.), and DMPA is 2,2-dimethylopropionic acid.

The following prepolymer samples were prepared with MDI isomer mixtures, such as Lupranate® MI and Mondur® ML, containing a high level of 2,4'-MDI.

Example 1

Prepolymer Preparation

The preparation of the prepolymers was conducted in a glove box with nitrogen atmosphere. A 2000 ml Pyrex®glass reaction kettle, which was equipped with an air pressure driven stirrer, a heating mantle, and a thermocoupletemperature measurement, was charged with about 382.5 grams of Terathane® 1800 glycol and about 12.5 grams of DMPA. This mixture was heated to about 50° C. with stirring, followed by the addition of about 105 grams of Lupranate® MI diisocyanate. The reaction mixture was then heated to about 90° C. with continuous stirring and held at about 90° C. for about 120 minutes, after which time the reaction was completed, as the % NCO of the mixture declined to a stable value, matching the calculated value (% NCO aim of 1.914) of the prepolymer with isocyanate end groups. The viscosity of the prepolymer was determined in accordance with the general method of ASTM D1343-69 using a Model DV-8 Falling Ball Viscometer (sold by Duratech Corp., Waynesboro, Va.) operated at about 40° C. The total isocyanate moiety content, in terms of the weight percent of NCO groups, of the capped glycol prepolymer was measured by the method of S. Siggia, "Quantitative Organic Analysis via Functional Group", 3rd Edition, Wiley & Sons, New York, pp. 559-561 (1963), the entire disclosure of which is incorporated herein by reference.

Example 2

Dispersion Making

The solvent-free prepolymer, as prepared according to the procedures and composition described in Example 1, was used to make the polyurethaneurea aqueous dispersion.

A 2,000 ml stainless steel beaker was charged with about 700 grams of de-ionized water, about 15 grams of sodium dodecylbenzenesulfonate (SDBS), and about 10 grams of triethylamine (TEA). This mixture was then cooled with ice/water to about 5° C. and mixed with a high shear laboratory mixer with rotor/stator mix head (Ross, Model 100LC) at about 5,000 rpm for about 30 seconds. The viscous prepolymer, prepared in the manner as Example 1 and contained in a metal tubular cylinder, was added to the bottom of the mix head in the aqueous solution through flexible tubing with applied air pressure. The temperature of the prepolymer was maintained between about 50° C. and about 70° C. The extruded prepolymer stream was dispersed and chain-extended with water under the continuous mixing of about 5,000 rpm. In a period of about 50 minutes, a total amount of about 540 grams of prepolymer was introduced and dispersed in water. Immediately after the prepolymer was added and dispersed, the dispersed mixture was charged with about 2 grams of Additive 65 (commercially available from Dow Corning®, Midland Mich.) and about 6 grams of diethylamine (DEA). The reaction mixture was then mixed for about another 30 minutes. The resulting solvent-free aqueous dispersion was milky white and stable. The viscosity of the dispersion was adjusted with the addition and mixing of Hauthane HA thickening agent 900 (commercially available from Hauthway, Lynn, Mass.) at a level of about 2.0 wt % of the aqueous dispersion. The viscous dispersion was then filtered through a 40 micron Bendix metal mesh filter and stored at room temperatures for film casting or lamination uses. The dispersion had solids level of 43% and a viscosity of about 25,000 centipoises. The cast film from this dispersion was soft, tacky, and elastomeric.

Example 3

Shirting Garments with Shaping Function

Two dispersion liquids with different solid particle contents are applied on two shirting garments, respectively. The aqueous polyurethane dispersion made in Example 2 is diluted with different amount of water to obtain the dispersion with various solid PU contents. The diluted dispersion is disposed on an area (25 cm×25 cm) of a stretch shirting garment as the fabric composite zone. The shirting base fabric with 3.19 OZ/yard$^2$ weight contains 97% cotton, 3% LYCRA® spandex fiber. The pick-up amount of aqueous dispersion is 85% of fabric weight. A paint roll is used to apple the dispersion onto the garment. After air dry, the garment is cured in a pressing machine under 150° C. for 1 minute. Then the fabric performance and weight in base fabric region and in fabric composite zone are tested. The results are list in table 1.

TABLE 1

| Shirting Fabrics | | | | | | | | | |
|---|---|---|---|---|---|---|---|---|---|
| Fabric Sample | Fabric type | Fabric Regions | Solid PU Content In Dispersion, % | Solid PU content in fabric % | Fabric Weight OZ/Y^2 | Fabric Stretch % | Fabric Growth % | Load Force @12% | Unload Force @12% |
| A0 | Shirting | Base fabric | 0 | 0.00 | 3.187 | 31.2 | 10.2 | 559.5 | 299.4 |
| A1 | Shirting | Fabric composite | 10% | 6.60 | 3.398 | 27.6 | 9.4 | 994.9 | 511.2 |
| A2 | Shirting | Fabric composite | 20% | 12.80 | 3.596 | 25.2 | 8.2 | 1476.4 | 782.4 |

We can see, in fabric composite area, the fabric stretch and growth reduced. The reduced amounts are related to the content of polyurethane. Higher content of PU, lower fabric stretch level and lower growth. That means, PU dispersion help to maintain the fabrics dimension and prevent shape changing. As compared with base fabric, more load force is needed to stretch the fabric composite to 12% elongation. And fabric composite have high recovery force (unload force) than base fabric.

Therefore, the garment in fabric composite zones could restrict the fabric deformation, give higher compression forces on the human body, and form the shaping effects.

Example 4

Denim Garments with Shaping Function

Two dispersion liquids with different solid particle contents are applied on two denim garments, respectively. The aqueous polyurethane dispersion made in Example 2 is diluted with different amount of water to obtain the dispersion with various solid contents. The diluted dispersion is disposed on buttock area (20 cm×20 cm) of stretch denim jeans. The denim base fabric with 10.18 OZ/yard$^2$ weight contains 98% cotton, 2% LYCRA® spandex fiber. The pick-up amount of aqueous dispersion is 85% of fabric weight. A paint stamp is used to apple the dispersion onto the garment. After air dry, the garment is cured in a pressing machine under 150° C. for 1 minute. Then the fabric performance and weight in base fabric area and fabric composite areas are tested. The results are list in table 2.

We can see, in fabric composite area, the denim fabric stretch and growth reduced. As the shirting in Example 3, the reduced amounts are related to the content of polyurethane. Higher content of PU, lower fabric stretch level and lower growth. That means that PU dispersion helps to maintain the fabrics dimension and shape. As compared with base denim fabric, more than two times of load force is needed to stretch the fabric composite to 12% elongation. And fabric composite have four times of recovery force (unload force) than base fabric.

Therefore, the jean in fabric composite zones could restrict the denim deformation, give higher compressions on the human body, and form shaping effect for pants, jeans and leggings.

Example 5

Knit Garments with Shaping Function

As Example 3 and 4, three dispersion liquids with different solid particle contents are applied on three top shirt with warp knit fabrics, respectively. The aqueous polyurethane dispersion made in Example 2 is diluted with different amount of water to obtain the dispersion with various solid contents. The diluted dispersion is disposed on a center area (30 cm×30 cm) of the warp knit garment. The base knit fabric with 6.11 OZ/yard$^2$ weight contains 82% Nylon, 18% LYCRA® spandex fiber. The pick-up amount of aqueous dispersion is 72% of fabric weight. A paint roll is used to apple the dispersion onto the garment. After air dry, the garment is cured in a pressing machine under 150° C. for 1 minute. Then the fabric performance and weight, from base region and shaping zones are tested. The results are list in table 3.

TABLE 2

| Denim Fabrics | | | | | | | | | |
|---|---|---|---|---|---|---|---|---|---|
| Fabric Sample | Fabric type | Fabric Regions | Solid PU Content In dispersion | Solid PU content in fabric % | fabric Weight OZ/Y^2 | Fabric Stretch % | Fabric Growth % | Load Force @12% | Unload Force @12% |
| B0 | Denim | Base fabric | 0 | 0.00 | 10.18 | 17.6 | 5 | 1541.7 | 514.5 |
| B1 | Denim | Fabric composite | 10% | 7.80 | 10.97 | 8.8 | 2.8 | 3349.8 | 1464.3 |
| B2 | Denim | Fabric composite | 20% | 17.70 | 11.985 | 6.4 | 1.6 | 4673.8 | 2095.4 |

TABLE 3

| Warp knit fabrics | | | | | | | |
|---|---|---|---|---|---|---|---|
| Fabric Sample | Fabric type | Fabric Function in Garment | Solid PU Content In dispersion | Solid PU content in fabric % | Fabric Weight OZ/Y^2 | Load Force in Machine Direction @30% | Unload Force in Machine Direction @30% |
| C0 | Warp Knit | Base fabric | 0 | 0 | 3.11 | 383.2 | 263.8 |
| C1 | Warp Knit | Fabric composite | 4 | 4.6 | 6.392 | 653.1 | 488.9 |
| C2 | Warp Knit | Fabric composite | 6 | 9.2 | 6.674 | 946.7 | 699.9 |
| C3 | Warp Knit | Fabric composite | 20 | 16.2 | 7.097 | 1244.8 | 900.4 |

As compared with base fabric C0, the fabric composite, C1, C2 and C3 have higher load force and higher unload force. The increased amounts are related to the content of polyurethane. The higher content of PU, the higher fabric load and unload force. As compared with base knit fabric C0, more than three times of load force is needed to stretch the fabric composite C3 to 30% elongation when PU solid content is 16.2%. And fabric composite C3 have more than three times of recovery force (unload force) than the base fabric at this PU content level.

Example 6

Wash Durability During Garment Manufacture

Denim composite fabrics with different solid PU contents (D1, D2, D3 and D4) are made by applying aqueous dispersion with various PU concentrations. The aqueous polyurethane dispersion is made as described in Example 2. The garments with fabric composites are cured with hot air at 150° C. for 1 minute in oven after dispersion application. The cured garment are treated by enzyme laundry wash with various chemicals used in jean garment wet commercial process.

Table 4 lists the change of solid polyurethane content before and after enzyme laundry. It clearly shows that majority of PU solid still stick on the fabric after strong laundry process in garment making. The loss of PU during garment manufacturing can be compensated by adding more PU solid in dispersion liquid.

TABLE 4

| Composition durability in garment manufacture processes | | | |
|---|---|---|---|
| Fabric Composite Sample | Solid PU content within aqueous dispersion, % | Solid PU content in fabric after dry, % | Solid PU content in fabric after garment enzyme washing, % |
| D1 | 8.6 | 7.2 | 7.5 |
| D2 | 12.9 | 14.4 | 11.3 |
| D3 | 17.2 | 14.3 | 12.5 |
| D4 | 21.5 | 20.7 | 15.7 |

Example 7

Garment Wash Durability in Home Laundry

Table 5 shows the wash durability of fabric composites during home laundry. The aqueous polyurethane dispersion, made as described in Example 2, are disposed in buttock areas of three pairs of jeans E1, E2 and E3 (12.5 OZ/yard$^2$ weight with 98% cotton and 2% elastic fiber). After applying the dispersion with 20% of PU solid content, three pairs of jeans are processed in different ways to fix the compositions on garment: by ironing with cotton setting; by curing in oven at 350° F. for 1 minute; and by pressing at 350° F. for 1 minute.

Then, the jeans go through repeat home laundry wash. After certain times washes, the solid PU content are tested and recorded. From Table 5, we can clearly see that the solid PU have very good wash durability for each fixation processes. After 30 times washing, PU still exist on the fabrics.

TABLE 5

| PU solid content change in home laundry | | | | | | |
|---|---|---|---|---|---|---|
| Garment | Fixiation Processing Methods | Before home laundry | 1 time home laundry | 5 times home laundry | 10 times home laundry | 30 times home laundry |
| E1 | Iron | 26.9 | 33.2 | 32.1 | 32.9 | 33.06 |
| E2 | Oven | 30.00 | 30.14 | 28.03 | 26.04 | 24.72 |
| E3 | Press | 28.3 | 29.0 | 29.2 | 29.48169 | 27.63 |

Example 8

Jeans with Shaping Function

The aqueous polyurethane dispersion, made as described in Example 2, are disposed in stretch jean F1 and F2 around buttock areas with U shape as illustrated in FIG. 5. The jeans have 10.2 OZ/yard$^2$ weight with 68% cotton, 30% Coolmax® polyester fiber and 2% Lycra® elastic fiber content. The dispersion with 20% and 30% solid PU contents are applied on jean F1 and jean F2 respectively. After cured at 350° F. degree for 1 minute at oven, the garments are treated in industry laundry machine with enzyme and other washing agents to simulate commercial jean stone wash. The jeans are further repeatedly washed in home laundry condition for 30 times.

After 30 times wash, for both jean F1 and F2, the PU polymers still stick with fibers and yarns in the fabrics. There is no noticeable color change in fabric composite zone. As compared with base fabric region, fabric composite zones have high elastic modulus, higher holding force and recovery power. This demonstrates the shaping function of garments can survive the industry treatment and home repeat wash.

The invention claimed is:

1. A garment with a shape enhancing function comprising at least one base fabric region and at least one fabric composite zone, said base fabric region comprising an elastic base fabric with at least about 15% stretch in at least one direction and said at least one fabric composite zone comprising said base fabric with a base fabric weight and an elastic polymer composition; wherein (a) the elastic polymer composition includes a polymer selected from the group consisting of elastomeric polyolefins, elastomeric polyurethanes, and elastomeric polyurethaneureas; (b) the elastic polymer composition is from about 1% to about 30% of the base fabric weight; and (c) the elastic polymer composition and the base fabric comprise a single layer of integrated fabric in the fabric composite zone.

2. The garment of claim 1, wherein one surface of the base fabric in the fabric composite zone includes a discontinuous coating of polymer particles.

3. The garment of claim 1, wherein said elastic polymer composition is substantially invisible from a surface of the garment.

4. The garment of claim 1, wherein said elastic polymer composition is applied as a melt, solution or dispersion.

5. The garment of claim 1, wherein said elastic polymer composition is an aqueous polyurethaneurea dispersion.

6. The article of claim 1, wherein said elastic polymer composition is substantially solvent free dispersion.

7. The garment of claim 1, wherein said garment comprises denim jeans.

8. The garment of claim 1, wherein said stretch fabric is selected from the group consisting of circular knit, warp knit, wovens, nonwoven, and combinations thereof.

9. The garment of claim 1, wherein the fabric composite zone is placed in a seat portion, a hip portion, a tummy portion, a thigh portion, or a waist portion and combinations thereof of the garment.

10. The garment of claim 1, wherein an unload force of said fabric composite zone is at least 15% higher than said base fabric at 12% elongation.

11. The garment of claim 1, wherein said elastic base fabric includes spandex.

12. The garment of claim 1, wherein said elastic base fabric includes polyester bi-component elastic fiber.

13. The garment of claim 1, wherein said fabric includes said elastic polymer composition in a pattern selected from the group consisting of dots, vertical lines, horizontal lines, diagonal lines, a grid, and combinations thereof.

14. A method of making a fabric for a garment or a garment with a shape enhancing function comprising (a) providing at least one base fabric region, said base fabric region comprising an elastic base fabric with at least about 15% stretch in at least one direction and said at least one fabric composite zone comprising said base fabric with a base weight and an elastic polymer composition; (b) applying an elastic polymer composition on one side of the elastic base fabric prior to garment preparation, to a garment prepared from the fabric or to both the fabric and garment; and (c) bonding the elastic polymer composite applied to the elastic base fabric prior to garment preparation, to a garment prepared from the fabric or to both the fabric and garment through drying or curing to produce a fabric for a garment or a garment with a shape enhancing function; wherein the elastic polymer composition includes a polymer selected from the group consisting of elastomeric polyolefins, elastomeric polyurethanes, and elastomeric polyurethaneureas; (ii) the elastic polymer composition is from about 1% to about 30% of the base fabric weight; and (iii) the elastic polymer composition and the base fabric comprise a single layer of integrated fabric in the fabric composite zone.

15. The method of claim 14 further comprising washing the fabric or the garment.

16. The method of claim 14, wherein the elastic polymer composition is applied on the fabric prior to garment preparation.

17. The method of claim 14, wherein the elastic polymer composition is applied on the fabric after garment making.

18. The method of claim 14, wherein the method of applying elastic polymer composition onto said base fabric in fabric composite zone is selected from the group consisting of coating; spraying; dipping; painting; printing: stamping, impregnating, and combinations thereof.

19. The method of claim 14, wherein the garment is cured at temperature higher than 100° C. with longer than 10 seconds.

* * * * *